US008011540B1

(12) United States Patent
Peckels

(10) Patent No.: US 8,011,540 B1
(45) Date of Patent: Sep. 6, 2011

(54) AERATOR BOTTLE POURER

(76) Inventor: David H. Peckels, Braham, MN (US)

( * ) Notice: Subject to any disclaimer, the term of this patent is extended or adjusted under 35 U.S.C. 154(b) by 642 days.

(21) Appl. No.: 12/060,743

(22) Filed: Apr. 1, 2008

(51) Int. Cl.
*B67D 3/00* (2006.01)

(52) U.S. Cl. ..... 222/479; 222/190; 222/478; 222/545; 222/547; 222/564; 222/567; 222/571

(58) Field of Classification Search ..... 222/478, 222/479, 481, 481.5, 482, 484, 545, 547, 222/564, 566–571, 190, 195
See application file for complete search history.

(56) References Cited

U.S. PATENT DOCUMENTS

| | | | | |
|---|---|---|---|---|
| 2,061,477 | A * | 11/1936 | Perry | 215/11.5 |
| 3,081,008 | A * | 3/1963 | Hester | 222/416 |
| 3,091,373 | A * | 5/1963 | Kirschenbaum | 222/420 |
| 3,323,693 | A * | 6/1967 | Miller | 222/479 |
| 3,973,701 | A * | 8/1976 | Gardner | 222/190 |
| 4,398,652 | A * | 8/1983 | Ueda et al. | 222/1 |
| 2004/0050883 | A1 * | 3/2004 | Wagner et al. | 222/484 |

* cited by examiner

*Primary Examiner* — J. Casimer Jacyna
(74) *Attorney, Agent, or Firm* — Dave Lingbeck

(57) ABSTRACT

An aerator bottle pourer for smoothing the taste of certain liquids such as wine and preventing dripping of the liquid after being poured from a bottle. The aerator bottle pourer includes a pouring assembly being removably engaged to a bottle for pouring liquid from the bottle, and also includes an aerating assembly being attached to the pouring assembly for aerating the liquid as it is being poured from the bottle.

15 Claims, 2 Drawing Sheets

AERATOR BOTTLE POURER

BACKGROUND OF THE INVENTION

1. Field of the Invention

The present invention relates to bottle pourers and more particularly pertains to a new aerator bottle pourer for smoothing the taste of certain liquids such as wine and preventing dripping of the liquid after being poured from a bottle.

2. Description of the Prior Art

The use of bottle pourers is known in the prior art. More specifically, bottle pourers heretofore devised and utilized are known to consist basically of familiar, expected and obvious structural configurations, notwithstanding the myriad of designs encompassed by the crowded prior art which have been developed for the fulfillment of countless objectives and requirements.

The prior art includes liquid pourers having spouts inserted into a bottle with hoses connected to the spouts for allowing air into the bottle, and also includes pourers having a pouring element with a pouring duct. While these devices fulfill their respective, particular objectives and requirements, the aforementioned prior arts do not disclose a new aerator bottle pourer.

SUMMARY OF THE INVENTION

The general purpose of the present invention, which will be described subsequently in greater detail, is to provide a new aerator bottle pourer which has many of the advantages of the bottle pourers mentioned heretofore and many novel features that result in a new aerator bottle pourer which is not anticipated, rendered obvious, suggested, or even implied by any of the prior art bottle pourers, either alone or in any combination thereof. The present invention includes a pouring assembly being removably engaged to a bottle for pouring liquid from the bottle, and also includes an aerating assembly being attached to the pouring assembly for aerating the liquid as it is being poured from the bottle. None of the prior art includes the combination of the elements of the present invention.

There has thus been outlined, rather broadly, the more important features of the aerator bottle pourer in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new aerator bottle pourer which has many of the advantages of the bottle pourers mentioned heretofore and many novel features that result in a new aerator bottle pourer which is not anticipated, rendered obvious, suggested, or even implied by any of the prior art bottle pourers, either alone or in any combination thereof.

Still another object of the present invention is to provide a new aerator bottle pourer for smoothing the taste of certain liquids such as wine.

Still yet another object of the present invention is to provide a new aerator bottle pourer that aerates and adds oxygen to the wine upon being poured from the bottle to aid in the release of the aromatic compounds from the wine.

Even still another object of the present invention is to provide a new aerator bottle pourer that prevents any further dripping of the liquid from a bottle once pouring has stopped These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
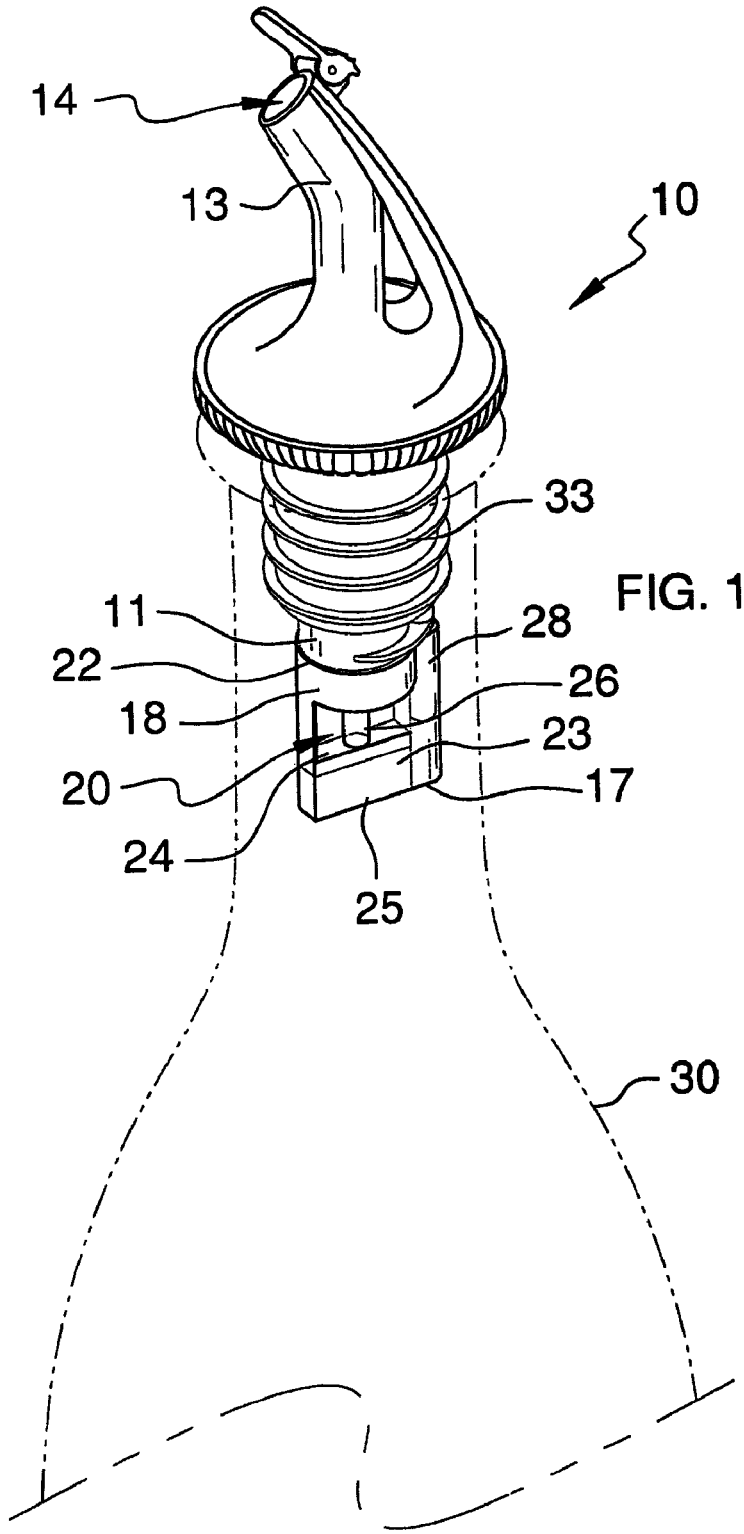
FIG. 1 is a perspective view of a new aerator bottle pourer according to the present invention.
Figure 2:
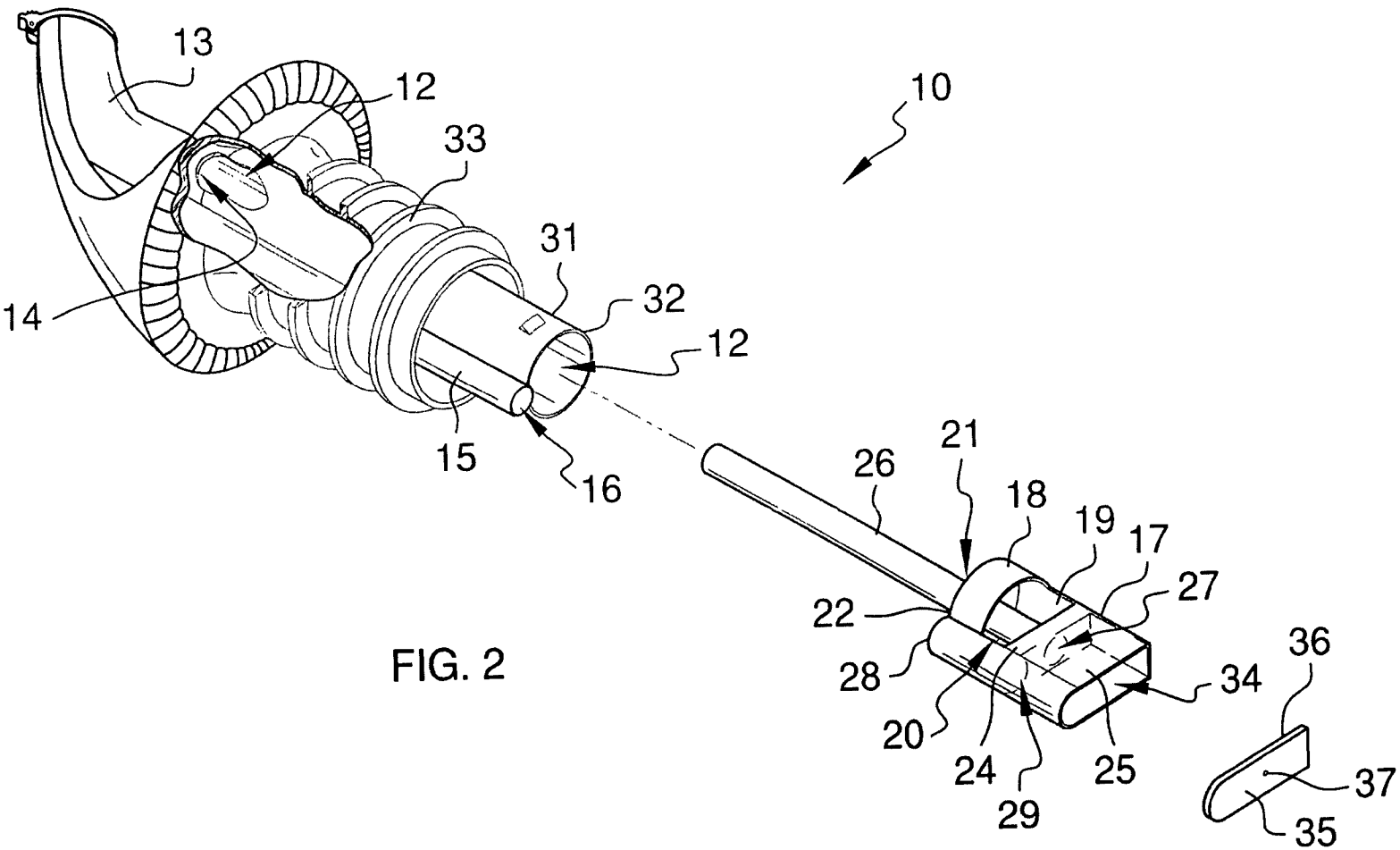
FIG. 2 is an exploded perspective view of the present invention.

With reference now to the drawings, and in particular to FIGS. 1 through 2 thereof, a new aerator bottle pourer embodying the principles and concepts of the present invention and generally designated by the reference numeral 10 will be described.

As best illustrated in FIGS. 1 through 2, the aerator bottle pourer 10 generally comprises a pouring assembly being removably engaged to a bottle 30 for pouring liquid from the bottle 30 and also comprises an aerating assembly being attached to said pouring assembly for aerating the liquid as it is being poured from the bottle 30. The pouring assembly includes a tubular member 11 having a bore 12 extending there through. The tubular member 11 is conventionally and removably extended in the bottle 30 through an open top thereof and through which liquid is passed, and also includes a spout 13 being conventionally attached to the tubular member 11 and having a passageway 14 extending therethrough and being in operable communication to the tubular member 11 through which liquid is poured from the bottle 30, and further includes an air tube member 15 having an air passageway 16 extending therethrough and being conventionally attached to and disposed in the tubular member 11 and extends the length thereof.

The aerating assembly includes a housing 17 being conventionally and removably attached at the bottom end 32 of the tubular member 11, and also includes an elongate air conduit member 26 having an air passage 27 extending therethrough, and being conventionally attached to the housing 17. The housing 17 includes an upper portion 18 and a lower portion 23 with a partition 24 separating the upper and lower portions 18,23 and sealing the lower portion 23 from the upper portion 18. The upper portion 18 of the housing 17 is conventionally attached at a bottom end 32 of the tubular member 11. The upper portion 18 has an open top end 21 and has at least one side wall 19 having at least one opening 20 being disposed therethrough to allow liquid from the bottle 30 to be passed through the at least one opening 20 and through the tubular member 11 and the spout 13. The open top end 21 of the upper portion 18 of the housing 17 has an edge portion 22 which is securely and conventionally attached about a bottom portion 31 of the tubular member 11. The lower portion 23 has an air chamber 25 disposed therein and has an open bottom 34 to facilitate the cleaning of the air chamber 25. A cap 35 is removably disposed over the open bottom 34 and has a boss portion 36 which is removably and sealingly engaged in the open bottom 34 of the lower portion 23 of the housing 17 to prevent liquid from the bottle 30 to enter the air chamber 25. The cap 35 is removable to allow the cleaning of the air chamber 25. The cap 35 also has a pin hole 37 being disposed therethrough to equalize pressure in the elongate air conduit member 26 to facilitate flow of the liquid through the at least one opening 20 of said housing 17.

The aerating assembly further includes an air tube extension 28 having an air conduit 29 extending therethrough and being conventionally disposed in the housing 17 and being in fluid communication with the air tube member 15. The air tube extension 28 is conventionally attached to and disposed upon and along an inner side of the at least one side wall 19 of the upper portion 18 of the housing 17. The air tube extension 28 extends through the partition 24 and is in fluid communication with the air chamber 25. In cooperation with the air tube member 15 and the spout 13, air passes through the air tube extension 28 and into the air chamber 25 from outside the bottle 30. Also, the elongate air conduit member 26 extends through the partition 24 and is in fluid communication with the air chamber 25, and extends into the tubular member 11 through the bottom end 32 thereof and is in fluid communication with the passageway 14 of the spout 13 for passing air from the air chamber 25 into the liquid as the liquid is being poured from the bottle 30. The elongate air conduit member 26 is disposed in the tubular member 11 such that liquid being passed through the tubular member 11 passes about the elongate air conduit member 26 and is dispensed through the spout 13 along with air from the elongate air conduit member 26 to aerate the liquid being dispensed through the spout 13. Also, the elongate air conduit member 26 is disposed in the tubular member 11 such that in cooperation with the air chamber 25, the air tube extension 28 and the air tube member 15, a vacuum is formed in the air chamber 25 after the liquid is dispensed from the bottle 30 thus resulting in any liquid remaining in the spout 13 being sucked back into the bottle 30 to prevent the liquid from dripping out of the spout 13.

In use, the aerator bottle pourer 10 has a bottle engagement member 33 conventionally attached about the tubular member 11 and has ribs which removably engages the bottle 30 in the neck thereof. The user tips the bottle 30 to dispense liquid from the bottle 30 with air passing into the chamber 25 and through the elongate air conduit member 26 with the liquid passing through the at last one opening 20 of the housing 17 and through the tubular member 11 with the air mixing with the liquid as it is dispensed through the spout 13 to smooth the taste of the liquid such as wine and to release the aromatic compounds found in the wine. Once finished with dispensing the liquid, the user tips of the bottle 30 and upon doing so, a vacuum is formed in the chamber 25 which causes any liquid in the spout 13 to be sucked back into the bottle 30 to prevent any dripping of the liquid from the spout 13.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the aerator bottle pourer. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An aerator bottle pourer comprising:

a pouring assembly being removably engaged to a bottle for pouring liquid from the bottle, said pouring assembly including a tubular member being removably extended in the bottle and through which liquid is passed, and also including a spout having a passageway extending therethrough and being in operable communication to said tubular member through which liquid is poured from the bottle, and further including an air tube member being disposed in said tubular member: and an aerating assembly being in operable communication to said pouring assembly for aerating the liquid upon being poured from the bottle, said aerating assembly including a housing being in operable communication at a bottom end of said tubular member to generally prevent spillage of the liquid from said spout, and also including an elongate air conduit member being connected to said housing to aerate the liquid in said spout, said housing including an upper portion and a lower portion with a partition separating said upper and lower portions and sealing said lower portion from said upper portion.

2. The aerator bottle pourer as described in claim 1, wherein said upper portion of said housing is attached at said the bottom end of said tubular member.

3. The aerator bottle pourer as described in claim 2, wherein said upper portion has an open top end and has at least one side wall having at least one opening being disposed therethrough to allow liquid from the bottle to be passed through said at least one opening and through said tubular member and said spout.

4. The aerator bottle pourer as described in claim 2, wherein said open top end of said upper portion of said housing has an edge portion which is attached about a bottom portion of said tubular member.

5. The aerator bottle pourer as described in claim 3, wherein said lower portion has an air chamber disposed therein.

6. The aerator bottle pourer as described in claim 5, wherein said lower portion also has an open bottom to facilitate cleaning of said air chamber.

7. The aerator bottle pourer as described in claim 6, wherein said aerating assembly also includes a cap which is removably disposed over said open bottom to prevent liquid from the bottle to enter said air chamber during use.

8. The aerator bottle pourer as described in claim 7, wherein said cap includes a boss portion which is removably and sealingly engaged in said open bottom of said lower portion of said housing.

9. The aerator bottle pourer as described in claim 8, wherein said cap also has a pin hole being disposed therethrough to equalize pressure in said elongate air conduit member to facilitate flow of the liquid through said at least one opening of said housing.

10. The aerator bottle pourer as described in claim 5, wherein said aerating assembly further includes an air tube extension being disposed in said housing and being in fluid communication with said air tube member.

11. The aerator bottle pourer as described in claim 10, wherein said air tube extension is disposed upon and along an inner side of said at least one side wall of said upper portion of said housing.

12. The aerator bottle pourer as described in claim 11, wherein said air tube extension extends through said partition and is in fluid communication with said air chamber, and in cooperation with said air tube member and said spout, passes air into said air chamber from outside the bottle.

13. The aerator bottle pourer as described in claim 12, wherein said elongate air conduit member extends through said partition and is in fluid communication with said air chamber, and extends into said tubular member through said bottom end thereof and is in fluid communication with said passageway of said spout for passing air from said air chamber into the liquid as the liquid is being poured from the bottle.

14. The aerator bottle pourer as described in claim 13, wherein said elongate air conduit member is disposed in said tubular member such that liquid being passed through said tubular member passes about said elongate air conduit member and is dispensed through said spout along with air from said elongate air conduit member to aerate the liquid being dispensed through said spout.

15. The aerator bottle pourer as described in claim 14, wherein said elongate air conduit member is disposed in said tubular member such that in cooperation with said air chamber, said air tube extension and said air tube member, a vacuum is formed in said air chamber after the liquid is dispensed from the bottle thus resulting in any liquid remaining in said spout being sucked back into the bottle to prevent the liquid from dripping from the spout.

* * * * *